US007980894B1

(12) United States Patent
Hall et al.

(10) Patent No.: US 7,980,894 B1
(45) Date of Patent: Jul. 19, 2011

(54) COAXIAL CONNECTOR WITH A CABLE RECEPTOR WITH AN OUTER CONTACT

(75) Inventors: John Wesley Hall, Harrisburg, PA (US); Douglas John Hardy, Middletown, PA (US); John Mark Myer, Millersville, PA (US); Sean Patrick McCarthy, Palmyra, PA (US); Hurley Chester Moll, Hershey, PA (US); Michael Fredrick Laub, Enola, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/861,561

(22) Filed: Aug. 23, 2010

(51) Int. Cl.
*H01R 9/05* (2006.01)

(52) U.S. Cl. ..... 439/585

(58) Field of Classification Search ..... 439/578–585
See application file for complete search history.

(56) References Cited

U.S. PATENT DOCUMENTS

| | | | | |
|---|---|---|---|---|
| 4,799,900 | A * | 1/1989 | Capp et al. | 439/585 |
| 6,217,381 | B1 * | 4/2001 | Kameyama | 439/578 |
| 6,837,743 | B2 * | 1/2005 | Ko | 439/582 |
| 7,318,730 | B2 * | 1/2008 | Miyazaki | 439/83 |
| 7,762,841 | B2 * | 7/2010 | Ho | 439/582 |

OTHER PUBLICATIONS

Drawing No. C-1438916, Customer Drawing for Part No. 1438916, Plug Kit, Unassembled, 1 Position, RG-316 or RG-174, 180 Degree, FAKRA, SMB, Jan. 27, 2005, 2 pgs, Tyco Electronics.
Drawing No. C-1438912, Customer Drawing for Part No. 1438912, Jack Kit, Unassembled, 1 Position, RG-316 or RG-174, FAKRA, SMB, Jan. 26, 2005, 2 pgs, Tyco Electronics.
Drawing No. C-1438896, Customer Drawing for Part No. 1438896, Socket Contact, Plug, SMB, Jan. 14, 2005, 1 pg, Tyco Electronics.
Drawing No. C-1438890, Customer Drawing for Part No. 1438890, Pin Contact, Jack, SMB, Jan. 13, 2005, 1 pg, Tyco Electronics.
Drawing No. C-1488364, Customer Drawing for Part No. 1488364, Shield, IDC, Plug, RG174/316, Strip Line, Oct. 16, 2002, 1 pg, Tyco Electronics.
Drawing No. C-1488358, Customer Drawing for Part No. 1488358, Shield, IDC, Receptacle, RG174/316, Strip Line, Oct. 16, 2002, 1 pg, Tyco Electronics.

* cited by examiner

*Primary Examiner* — Chandrika Prasad

(57) ABSTRACT

A coaxial cable connector is provided. The connector includes a housing and a subassembly. The subassembly includes a cable receptor including a receptor portion configured to receive a cable, and an outer contact formed integrally with and extending axially from the receptor portion. The outer contact configured to electrically couple to an outer conductor of the cable. A dielectric is positioned within the outer contact of the cable receptor. A center contact assembly is positioned within the dielectric and configured to electrically couple to an inner conductor of the cable. A cable retainer is configured to couple to the receptor portion of the cable receptor. The cable retainer has at least one cable retention contact configured to retain the cable.

20 Claims, 8 Drawing Sheets

COAXIAL CONNECTOR WITH A CABLE RECEPTOR WITH AN OUTER CONTACT

BACKGROUND OF THE INVENTION

The subject matter herein relates generally to electrical connector assemblies, and more specifically, to connector assemblies for coaxial cables.

In the past connectors have been proposed for interconnecting coaxial cables. Generally, coaxial cables have a circular geometry formed with a central conductor (of one or more conductive wires) surrounded by a cable dielectric material. The dielectric material is surrounded by a cable braid (of one or more conductive wires) that serves as a ground, and the cable braid is surrounded by a cable jacket. In most coaxial cable applications, it is preferable to match the impedance between source and destination electrical components located at opposite ends of the coaxial cable. Consequently, when sections of coaxial cable are interconnected by connector assemblies, it is preferable that the impedance remain matched through the interconnection.

Today, coaxial cables are widely used. Recently, demand has arisen for radio frequency (RF) coaxial cables in automotive applications. The demand for RF coaxial cables in the automotive industry is due in part to the increased communications content within automobiles, such as AM/FM radios, cellular phones, GPS, satellite radios. Blue Tooth™ compatibility systems and the like. The wide applicability of coaxial cables demands that connected coaxial cables maintain the impedance at the interconnect ion.

Conventional coaxial connector assemblies include plug and receptacle assemblies that mate together. The assemblies include plastic housings, metal outer shields, dielectrics and metal center contact assemblies. The assemblies receive and retain coaxial cable ends, and each of the outer shields enclose the dielectric housings. Electrical termination to the braid of the coaxial cable is completed by positioning the braid between inner and outer ferrules. The ferrules are normally manufactured from a metal material. The center contact assemblies engage the center conductors of the coaxial cable. When the plug and receptacle assemblies are mated, the housings are engaged, the outer shields are interconnected, the dielectrics are engaged and the center contact assemblies are interconnected. Some coaxial cable connectors are further enclosed in a plastic housing to secure the connection and prevent accidental uncoupling.

However, as transmission rates increase, impedance matching problems may arise due to the size, orientation, and placement of the cables, center contact assemblies, and plug and receptacle assemblies of coaxial connector assemblies. Additionally, conventional coaxial connector metal outer shields may be die cast or screw machined and require excessive time and costs to produce.

Thus a need remains for a coaxial connector assembly capable of controlling the electrical characteristics through the interconnection in a cost effective and reliable manner. Another need remains for a cost effective means for forming coaxial connector assemblies.

SUMMARY OF THE INVENTION

In one embodiment, a coaxial cable connector is provided. The connector includes a housing and a subassembly. The subassembly includes a cable receptor including a receptor portion configured to receive a cable, and an outer contact formed integrally with and extending axially from the receptor portion. The outer contact configured to electrically couple to an outer conductor of the cable. A dielectric is positioned within the outer contact of the cable receptor. A center contact assembly is positioned within the dielectric and configured to electrically couple to an inner conductor of the cable. A cable retainer is configured to couple to the receptor portion of the cable receptor. The cable retainer has at least one cable retention contact configured to retain the cable.

In another embodiment, a coaxial cable connector is provided. The connector includes a housing and a subassembly configured to rotate within the housing. The subassembly includes a cable receptor including a receptor portion configured to receive a cable, and an outer contact formed integrally with and extending axially from the receptor portion. The outer contact configured to electrically couple to an outer conductor of the cable. A dielectric is positioned within the outer contact of the cable receptor. A center contact assembly is positioned within the dielectric and configured to electrically couple to an inner conductor of the cable. A cable retainer is configured to couple to the receptor portion of the cable receptor. The cable retainer has at least one cable retention contact configured to retain the cable. A lock is configured to retain the subassembly within the housing and prevent axial movement of the subassembly with respect to the housing.

DETAILED DESCRIPTION OF THE DRAWINGS

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
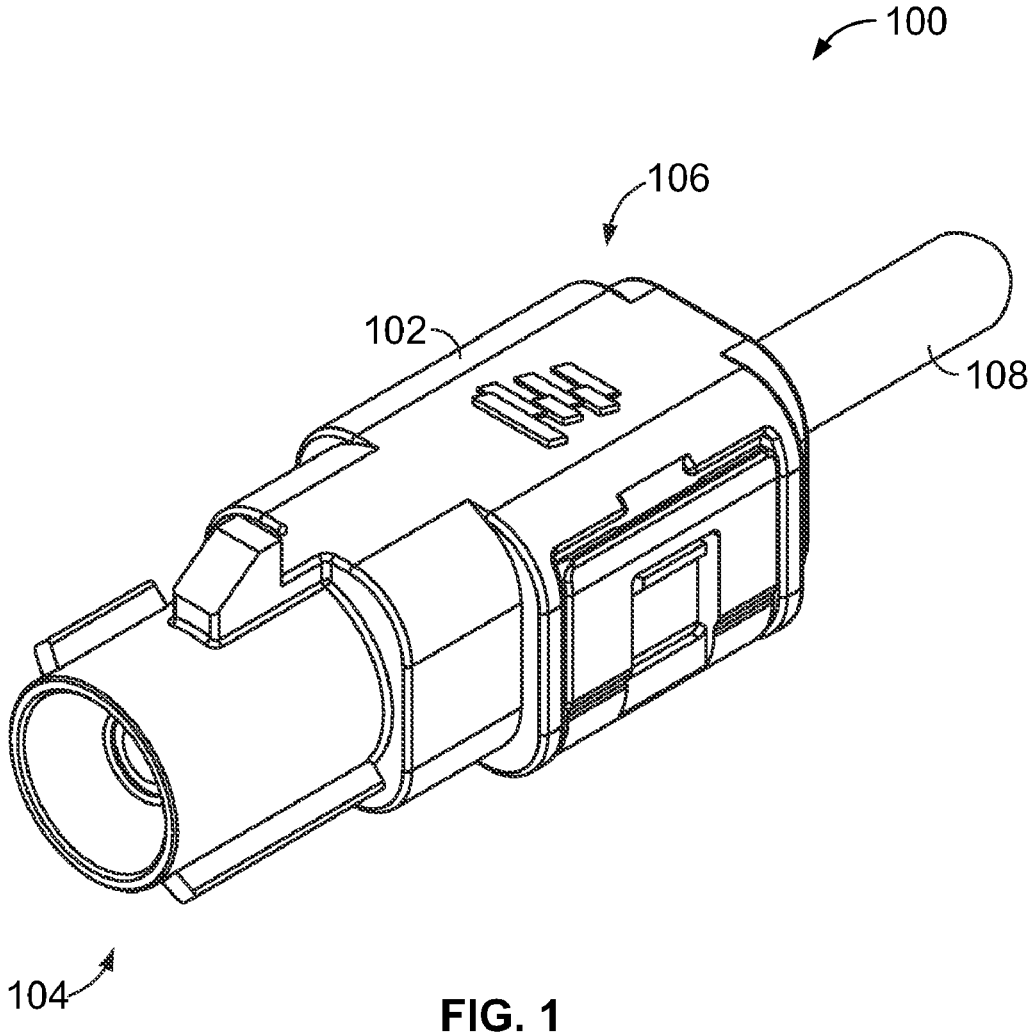
FIG. 1 is a perspective view of a coaxial cable jack connector formed in accordance with an embodiment.

FIG. 1 is a perspective view of a coaxial cable jack connector 100 in accordance with an embodiment. The cable jack connector 100 includes a housing 102 having a mating end 104 and a wire end 106. The housing 102 is configured to enclose an outer contact assembly 114 (shown in FIG. 2) and a center contact assembly 112 (shown in FIG. 2) housed therein. A coaxial cable 108 extends through the wire end 106 and is electrically coupled to the outer contact assembly 114 and the center contact assembly 112. The outer contact assembly 114 is electrically coupled to a cable braid 126 (shown in FIG. 2) of the coaxial cable 108. The center contact assembly 112 is electrically coupled to the inner conductor 130 (shown in FIG. 2) of the coaxial cable 108. The outer contact assembly 114 and the center contact, assembly 112 extend towards the mating end 104 of the coaxial cable jack connector 100. The mating end 104 is configured to electrically and mechanically couple to a mating end of a plug. The outer contact assembly 114 carries electrical energy from a braid 126 (shown in FIG. 2) of the coaxial cable 108 to a cable plug connector 300 (shown in FIG. 12). The center contact assembly 112 carries an electrical signal between an inner conductor 130 (shown in FIG. 2) of the coaxial cable 108 to the cable plug connector 300.

Figure 2:
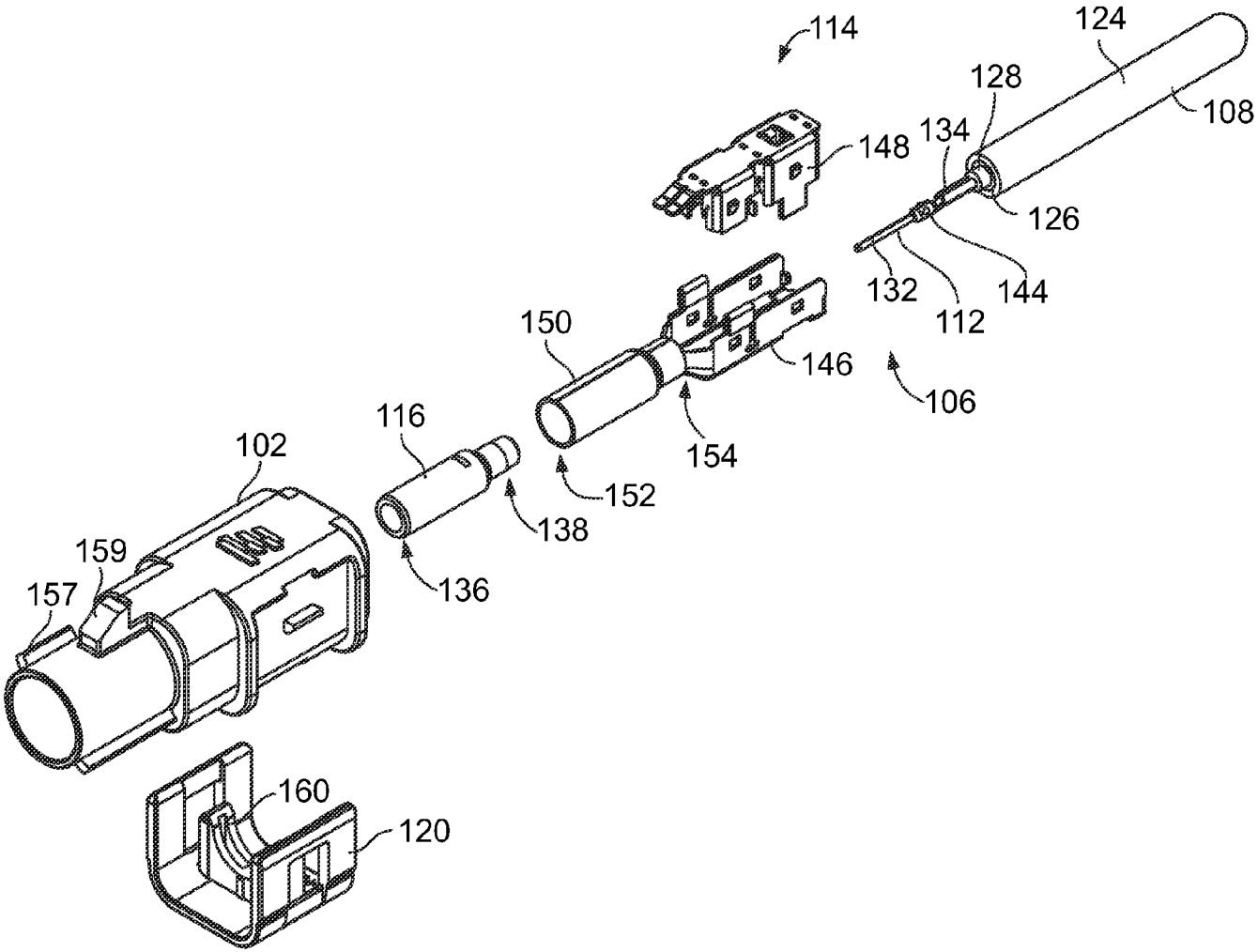
FIG. 2 is an exploded view of the cable jack connector, shown in FIG. 1.

FIG. 2 is an exploded view of the cable jack connector 100, shown in FIG. 1. The jack connector 100 includes the housing 102, a center contact assembly 112, an outer contact assembly 114, a dielectric 116, and a lock 120. The jack connector 100 is configured to couple to the coaxial cable 108. The coaxial cable 108 includes a jacket 124, a cable braid 126, a cable dielectric 128, and an inner conductor 130. The inner conductor 130 electrically couples to the center contact assembly 112. The cable braid 126 electrically couples to the outer contact assembly 114 by way of one or more cable retention contacts. The center contact assembly 112 is received within the dielectric 116. The dielectric 116 is received within the outer contact assembly 114. The housing 102 encloses the outer contact assembly 114, the dielectric 116, and the center contact assembly 112.

The center contact assembly 112 includes a center contact assembly tip 132 and a crimp barrel 134. The crimp barrel 134 crimps to the inner conductor 130 of the cable 108. The center contact assembly tip 132 of the center contact assembly 112 extends axially from the crimp barrel 134. The center contact assembly 112 is positioned within the dielectric 116 of the jack connector 100. The dielectric 116 is cylindrical in shape and includes a mating end 136 and a wire end 138. The wire end 138 is configured to receive the formed crimp barrel 134 of the center contact assembly 112. The transition between the crimp barrel 134 and the center contact assembly tip 132 includes at least one barb 144 that creates an interference fit with an inner latch (not shown) of the dielectric 116. The center contact assembly tip 132 of the center contact assembly 112 extends through and is axially centered within the mating end 136 of the dielectric. The center contact assembly tip 132 and the dielectric mating end 136 may be configured to FAKRA specifications, or the like, and are configured to mate with a plug having common specifications.

The outer contact assembly 114 includes a cable receptor 146 and a cable retainer 148. The cable receptor 146 and the cable retainer 148 are stamped and formed pieces. The cable receptor 146 is configured to receive the coaxial cable 108. The cable retainer 148 mates with the cable receptor 146 to retain the coaxial cable 108 therein. The cable retainer 148 includes at least one cable retention contact 202 (shown in FIG. 5) that pierces the jacket 124 and engages the cable braid 126 of the coaxial cable 108. Optionally, the cable retention contact 202 may only pierce the jacket 124 of cable 108. The cable retainer 148 may also contain an additional electrical contact 204 (shown in FIG. 5) that engages the cable braid 126 of the coaxial cable 108. The cable retention contact 202 and electrical contact 204 electrically couple the braid 126 of the coaxial cable 108 to the outer contact assembly 114. The cable receptor 146 includes an outer contact 150. The outer contact 150 includes a mating end 152 and a wire end 154.

The dielectric 116 is configured to be received within the outer contact 150. The wire end 138 of the dielectric 116 is sized to be received within the wire end 154 of the outer contact 150. The mating end 136 of the dielectric 116 is sized to be received within the mating end 152 of the outer contact 150. The outer contact 150 is insulated from the inner contact 132 by the dielectric 116. The outer contact 150, the dielectric 116, and the center contact assembly 112 are configured to be mated with a corresponding electrical plug.

The jacket 124, cable braid 126, and cable dielectric 128 are configured to be stripped to expose the inner conductor 130 of the cable 108. The crimp barrel 134 of the center contact assembly 112 is configured to couple to the inner conductor 130 of the cable 108. The center contact assembly 112 is then positioned within the dielectric 116 and frictionally held in place by the barbs 144. The dielectric 116 is configured to position within the outer contact 150 so that the dielectric 116 isolates the center contact assembly 112 from the outer contact 150.

The housing 102 encloses the outer contact assembly 114. The housing 102 covers the outer contact assembly 114 and the center contact assembly 112. The wire end 106 of the housing 102 encloses the cable receptor 146 and the cable retainer 148 of the outer contact assembly 114. The mating end 104 of the housing 102 encloses the outer contact 150, the dielectric 116, and the center contact assembly 112 and is configured for mating with a corresponding plug. The mating end 104 may also include keys 157 and a catch 159' for polarizing the mating end 104. The keys 157 and the catch 159 may be configured to FAKRA specifications and are configured to mate with a plug having common specifications.

The lock 120 is inserted adjacent the wire end 106 of the housing 102 to retain the outer contact assembly 114 within the housing 102. The lock 120 includes a retention ring 160 that prevents the outer contact assembly 114 from being dislodged from the housing 102 when the coaxial cable 108 is subjected to axial forces. In an exemplary embodiment, the lock 120 blocks axial movement, but allows the outer contact assembly 114 to rotate within the housing 102. Optionally, the outer contact assembly 114 may rotate 360 degrees within the housing 102.

Figure 3:
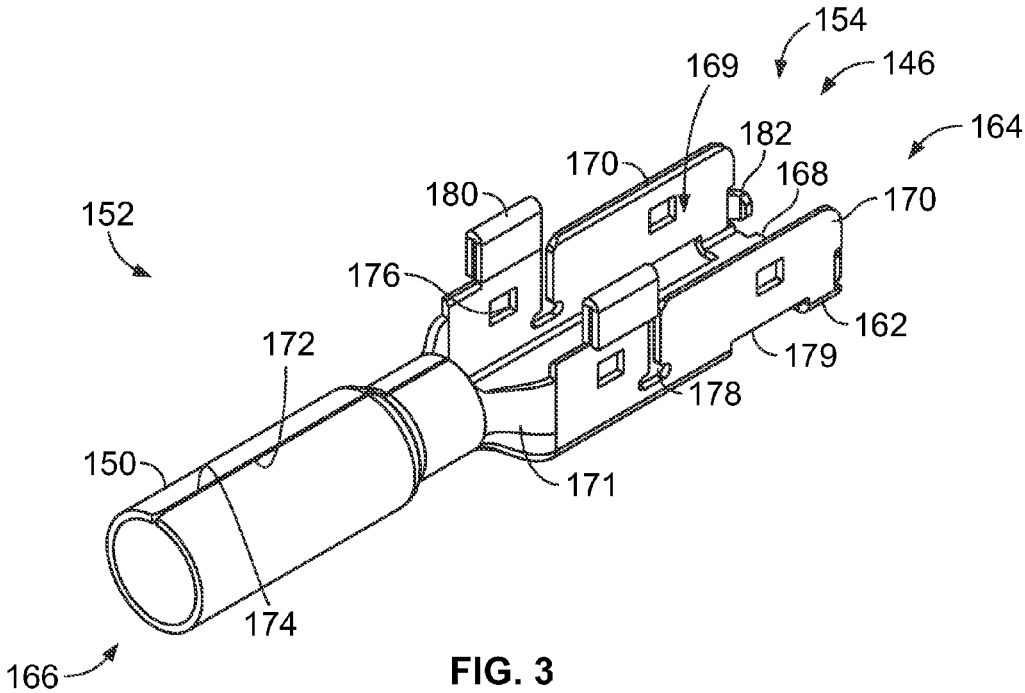
FIG. 3 is a perspective view of the cable receptor, shown in FIG. 2.

FIG. 3 is a perspective view of the cable receptor 146. The cable receptor 146 includes the outer contact 150 and a receptor portion 162. The receptor portion 162 is positioned at a wire end 164 of the cable receptor 146 and the outer contact 150 is positioned at a mating end 166 of the cable receptor 146. The cable receptor 146 is stamped from sheet metal and then formed into a particular shape. The receptor portion 162 and the outer contact 150 are formed as an integral piece. The receptor portion 162 includes a base 168 and a pair of side walls 170 extending from opposite sides of the base 168. The side walls 170 extend from a transition portion 171 of the cable receptor to the wire end 164 of the cable receptor 146. The side walls 170 are bent with respect to the base 168 so that the side walls 170 are approximately perpendicular to the base 168 and form a channel 169. The outer contact 150 has edges 172 and 174 folded into contact with one another so that the outer contact 150 has a cylindrical shape or barrel shape between the mating end 152 and the wire end 154. The mating end 152 of the outer contact 150 may be configured to FAKRA specifications.

Figure 4:
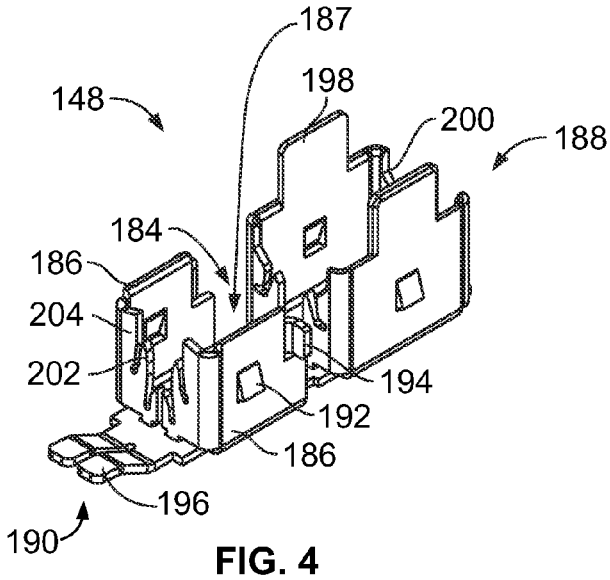
FIG. 4 is perspective view of the cable retainer, shown in FIG. 2.

The receptor portion 162 includes at least one window 176 configured to secure the cable receptor 146 to the cable retainer 148 (shown in FIG. 4). An alignment slot 178 extends through the side walls 170 to align the cable receptor 146 with respect to the cable retainer 148. A clamping feature, such as clamping feature slot 179 extends along a junction of the base 168 and each side wall 170. The clamping feature slots 179 are further configured to retain the cable receptor 146 with respect to the cable retainer 148. A retaining tab 180 extends from each side wall 170 to retain the outer contact assembly 114 within the housing 102. At least one centering tab 182 extends from the side wall 170 proximate to the wire end 164 of the receptor portion 162. The centering tabs 182 center the coaxial cable 108 (shown in FIG. 1) within the cable receptor 146.

Figure 5:
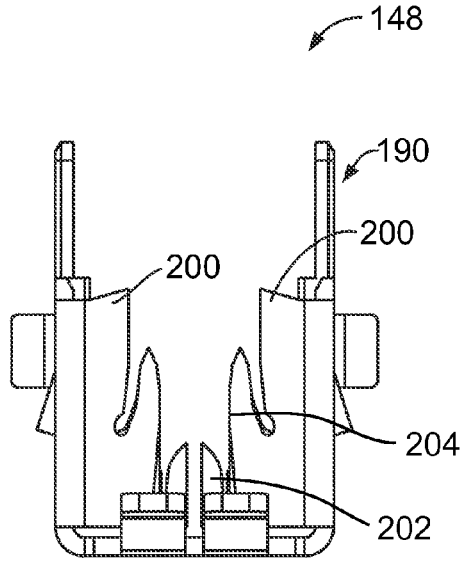
FIG. 5 is an end view of the cable retainer, shown in FIG. 4.

FIG. 4 is a perspective view of the cable retainer 148. FIG. 5 is a view of the mating end 190 of cable retainer 148. In the exemplary embodiment, the cable retainer 148 is stamped from sheet metal and then formed into a particular shape. The cable retainer 148 includes a base 184 and side walls 186 extending from opposite sides of the base 184. The side walls 186 are bent to a position approximately perpendicular with respect to the base 184 and form a channel 187. The cable retainer 148 includes a wire end 188 and a mating end 190.

The cable retainer 148 includes at least one tab 192 configured to be received within the one or more windows 176 (shown in FIG. 3) of the cable receptor 146 (shown in FIG. 3). The tabs 192 lock into the windows 176 to secure the cable retainer 148 to the cable receptor 146. An alignment tab 194 extends from each side wall 186. The alignment tab 194 is configured to be received in the alignment slot 178 (shown in FIG. 3) of the cable receptor 146 to align the cable retainer 148 and the cable receptor 146. A shielding tab 196 extends from the mating end 190. The shielding tab 196 is positionable against the outer contact 150 (shown in FIG. 3) of the cable receptor 146 to provide electrical shielding and enhance the shielding effectiveness of the connector. A clamping feature 198 extends from each sidewall 186. The clamping feature 198 is configured to be received in a corresponding clamping feature slot 179 (shown in FIG. 3). After assembly of the cable retainer 148 into the cable receptor 146, the clamping feature 198 is configured to bend into a position adjacent the base 168 of the cable receptor 146 to further retain the cable receptor 146 and the cable retainer 148. Cable retention contacts 200 are positioned at the wire end 188 and are configured to abut the cable 108 to retain the cable 108 within the cable retainer 148. Cable retention contacts 204 are positioned between the cable retention contacts 200 and are configured to pierce the jacket 124 and braid 126 of the coaxial cable 108 to provided resistance to axial forces on the cable 108. In one embodiment, the cable retention contact 204, also pierces the cable dielectric 128 to provide further resistance to axial force on the cable 108. The cable retention contact 204 electrically couples the cable braid 126 to the outer contact assembly 114. Cable retention contacts 202 are positioned between the cable retention contacts 204. The cable retention contacts 202 pierce the jacket 124 of the cable 108 to retain the cable 108 within the cable retainer 148.

Figure 6:
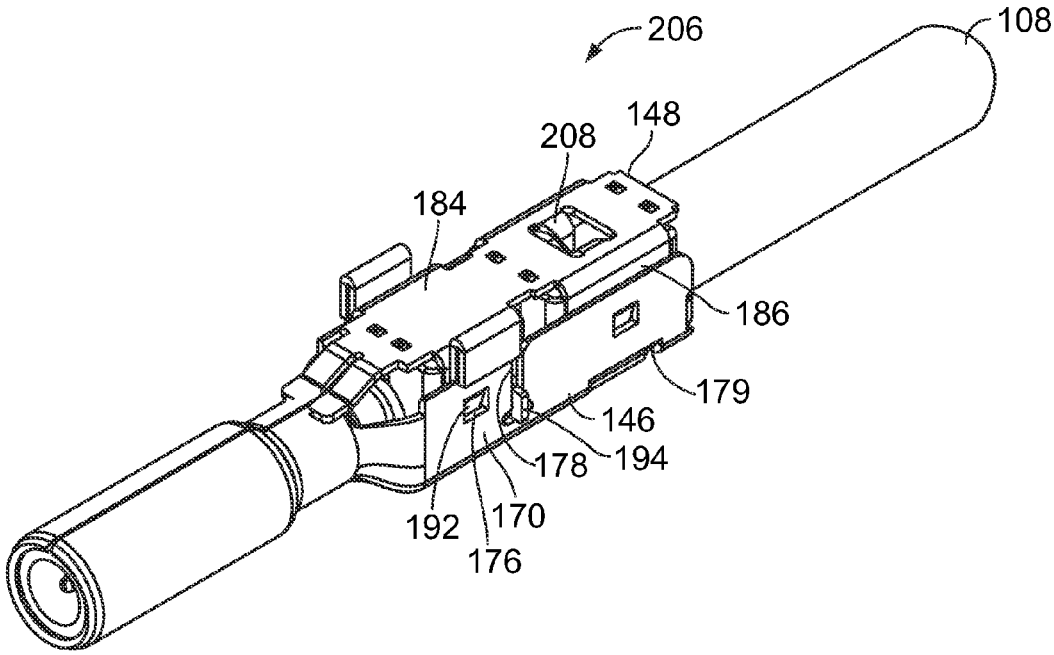
FIG. 6 is a top perspective view of a jack subassembly formed by coupling the cable retainer, shown in FIG. 2, to the cable receptor, shown in FIG. 2.
Figure 7:
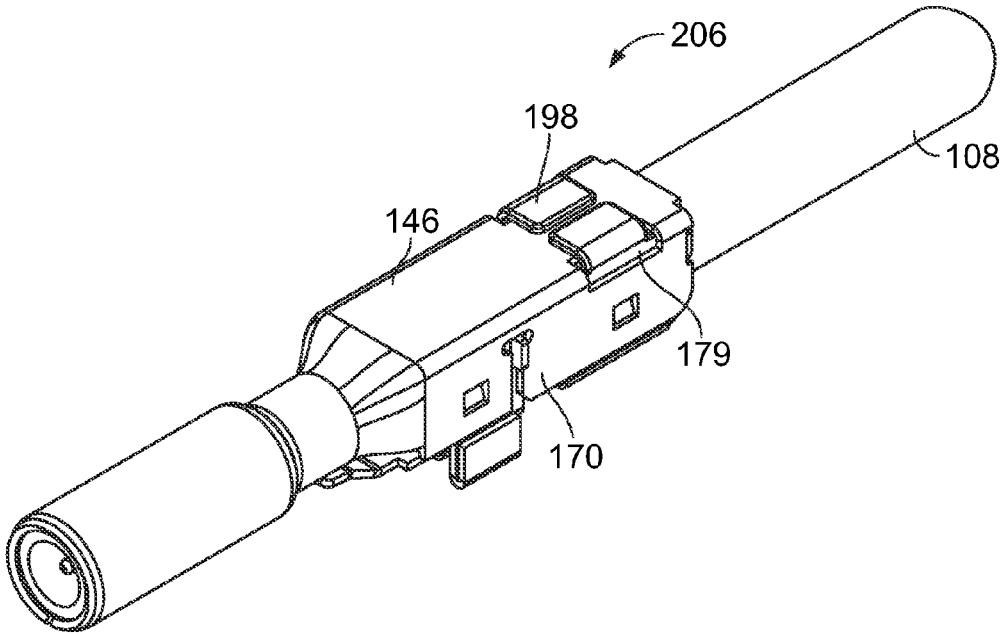
FIG. 7 is a bottom perspective view of the jack subassembly, shown in FIG. 6.

FIG. 6 is a jack subassembly 206 formed by coupling the cable retainer 148 to the cable receptor 146. FIG. 7 is a bottom perspective view of the jack subassembly 206, shown in FIG. 6. The coaxial cable 108 is positioned within the cable receptor 146 and centered with centering tabs 182. The cable retainer 148 is received within the cable receptor 146 to retain the coaxial cable 108 therein. The side walls 186 of the cable retainer 148 are received within the side walls 170 of the cable receptor 146. The alignment tabs 194 are received in the corresponding alignment slots 178 of the cable receptor 146 to align the cable retainer 148 and the cable receptor 146. The tabs 192 of the cable retainer 148 are received within the windows 176 of the cable receptor 146 to secure the cable retainer 148 to the cable receptor 146. The clamping features 198 are received in a corresponding clamping feature slot 179. The clamping feature 198 is bent into a position adjacent the base 168 of the cable receptor 146 to secure the cable receptor 146 and the cable retainer 148, as shown in FIG. 7. The clamping features 198 bend inward toward one another. The clamping features 198 are bent substantially perpendicular to the side walls 186 so that the clamping features 198 abut the base 168 of the cable receptor 146. FIG. 6 illustrates a pair of strain relief barbs 208 extending from the base 184 of the cable retainer 148. The strain relief barbs 208 are bent inward to pierce the jacket 124 of the cable 108 to provide relief from axial forces on the cable 108.

Figure 8:
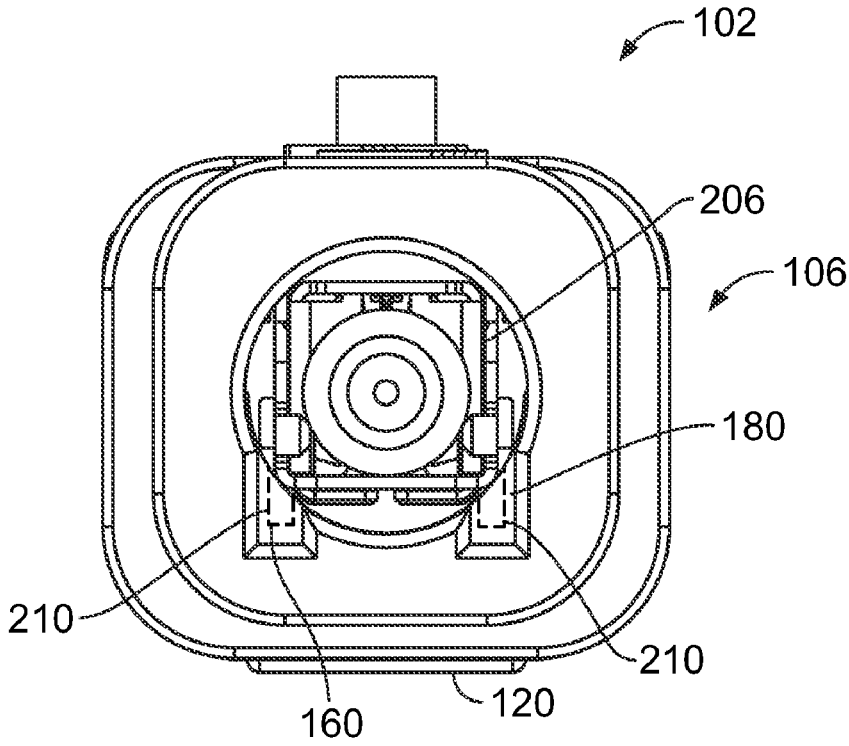
FIG. 8 is an end view of the housing, shown in FIG. 2, having the lock, shown in FIG. 2, inserted therein.

FIG. 8 is an end view of the housing 102 and the lock 120 inserted therein. FIG. 8 is a view of the wire end 106 of the housing 102. The jack subassembly 206 is positioned within the housing 102. The housing 102 includes a pair of retaining slots 210. The retaining tabs 180 of the cable receptor 146 are received within the retaining slots 210 to couple the jack subassembly 206 within the housing 102. Once the jack subassembly 206 is installed in the housing 102, the lock 120 is installed into the housing 102 to close access to the retaining slots 210, thereby preventing the removal of the retaining tabs 180 through the retaining slots. The retention ring 160 of the lock 120 closes the access to the retaining slots 210 and thus retains the jack subassembly 206 within the housing 102. In the exemplary embodiment, the lock 120 blocks axial movement, but allows the jack subassembly 206 to rotate within the housing 102. Optionally, the jack subassembly may rotate 360 degrees within the housing 102.

Figure 9:
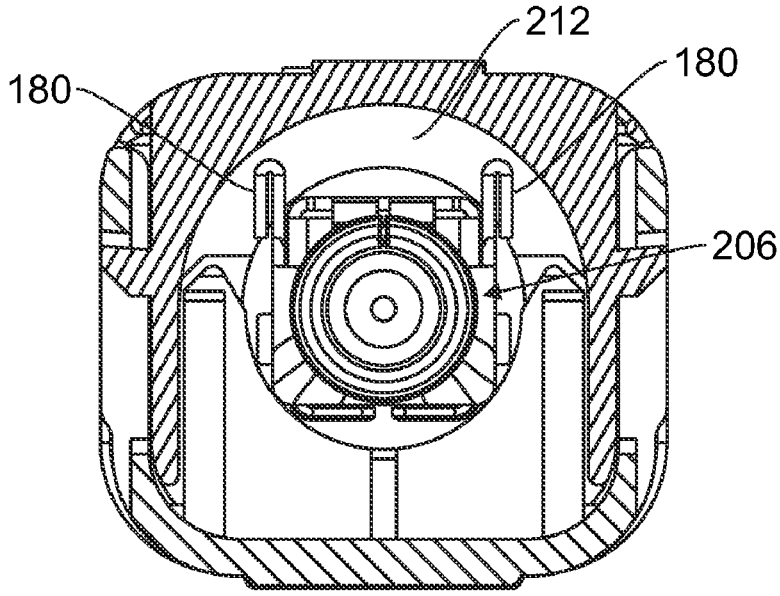
FIG. 9 is a cross sectional view of the jack subassembly positioned within the housing.

FIG. 9 is a cross-sectional view of the jack subassembly 206 positioned within the housing 102 with the lock 120 removed. The housing 102 includes a channel 212. The retaining tabs 180 of the cable receptor 146 are positioned within the channel 212. The channel 212 allows rotation of the jack subassembly 206 therein. In one embodiment, the jack subassembly 206 rotates 180 degrees within the housing 102. In another embodiment, the jack subassembly 206 may rotate a full 360 degrees within the housing 102. FIG. 9 illustrates the jack subassembly 206 rotated 180 degrees from FIG. 8. The lock 120 maintains the axial position of the jack subassembly 206 during rotation. The channel 212 allows the jack connector 100 to rotate with respect to a plug connector 300 (shown in FIG. 12) when the jack connector 100 is coupled to the plug connector 300. Rotation of the jack connector 100 with respect to the plug connector 300 eases assembly of the jack connector 100 with respect to the plug connector 300.

Figure 10:
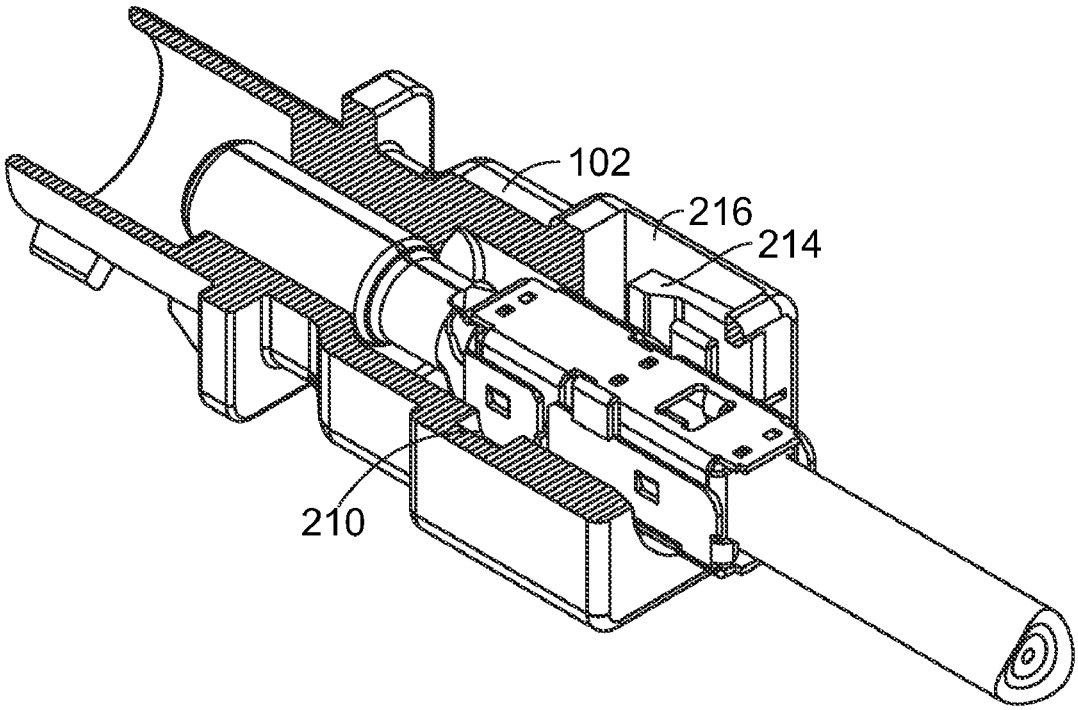
FIG. 10 is a perspective cutaway view of housing having the retention latch.

FIG. 10 is a perspective cutaway view of the housing 102 having the retention latch 214 formed integrally therewith. The retention latch 214 is positioned within one of the retaining slots 210. Optionally, a retention latch 214 may be positioned in each of the retaining slots 210. The retention latch 214 is configured to bend outward toward a housing side wall 216 when the retaining tabs 180 of the jack subassembly 206 are positioned within the retaining slots 210. Once the jack subassembly 206 is in position within the housing 102, the retention latch 214 moves into a locking position to lock the retaining tabs 180 in place within the channel 212.

Figure 11:
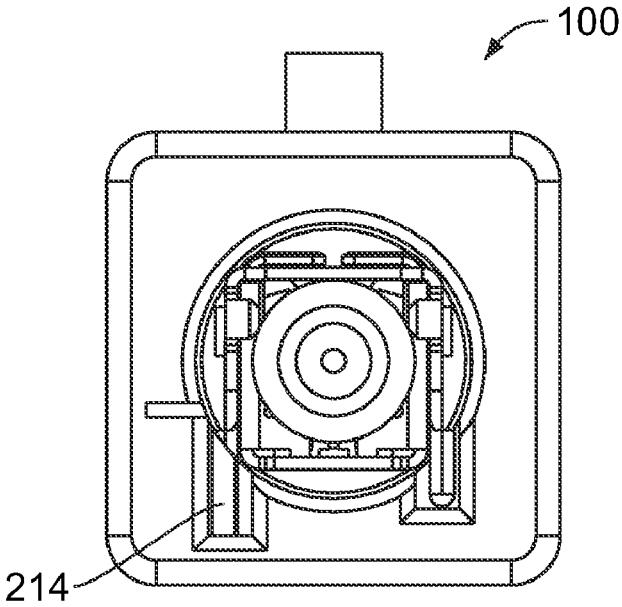
FIG. 11 is an end view of the housing, shown in FIG. 10.

FIG. 11 is an end view of the housing 102. FIG. 11 illustrates the retention latch 214 in a closed position. In the closed position, the jack subassembly is locked within the housing 102 to prevent axial movement and is allowed to rotate within the channel 212.

Figure 12:
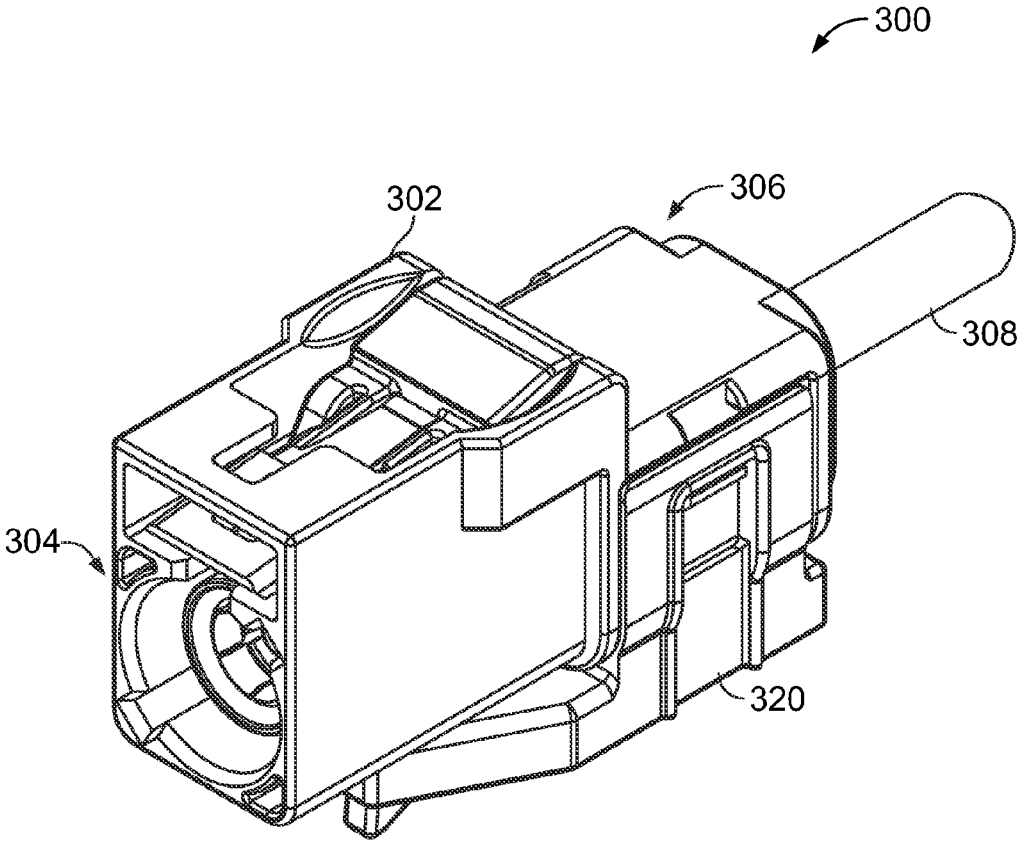
FIG. 12 is a perspective view of a coaxial cable plug connector formed in accordance with an embodiment.

FIG. 12 is a perspective view of a coaxial cable plug connector 300. The cable plug connector 300 includes a housing 302 having a mating end 304 and a wire end 306. The housing 302 is configured to enclose an outer contact assembly 314 (shown in FIG. 13) and a center contact assembly 312 (shown in FIG. 13) housed therein. A coaxial cable 308 extends through the wire end 306 and is electrically coupled to the outer contact assembly 314 and the center contact assembly 312. The outer contact assembly 314 is electrically coupled to a cable braid of the coaxial cable 308. The center contact assembly 312 is electrically coupled to an inner conductor 330 (shown in FIG. 13) of the coaxial cable 308. The outer contact assembly 314 and the center contact assembly 312 extend towards the mating end 304 of the coaxial cable plug connector 300. A lock 320 retains the center contact assembly 312 and the outer contact assembly 314 within the housing 302. The mating end 304 is configured to electrically couple to the mating end 104 of the cable jack connector 100 (shown in FIG. 1). The outer contact assembly 314 and the center contact assembly 312 carry an electrical signal through the cable plug connector 300 and the cable jack connector 100.

Figure 13:
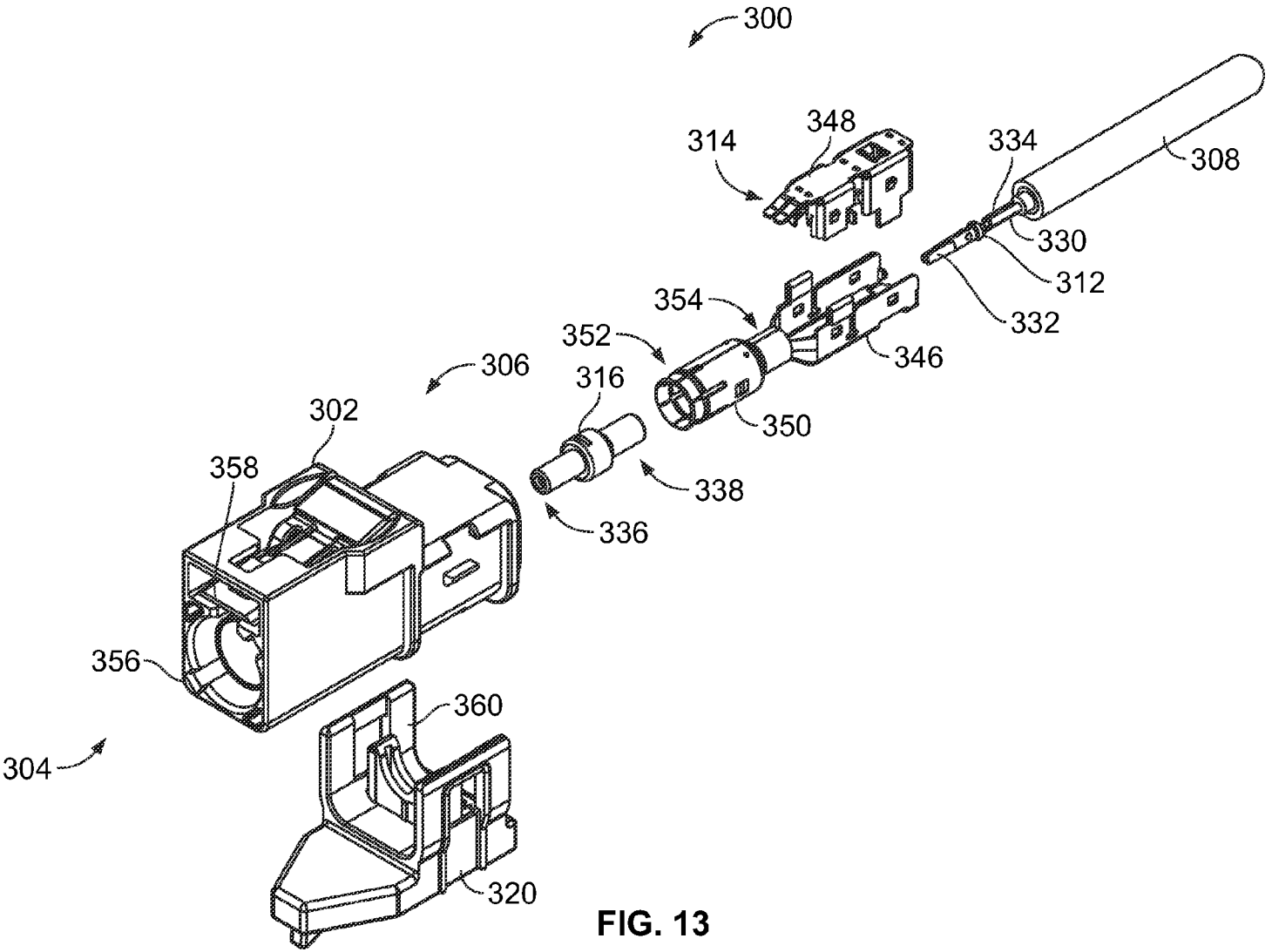
FIG. 13 is an exploded view of the plug connector, shown in FIG. 12.

FIG. 13 is an exploded view of the cable plug connector 300, shown in FIG. 12. The components of the cable plug connector 300 are similar to the components of the cable jack connector 100. The plug connector 300 includes the housing 302, a center contact assembly 312, an outer contact assembly 314, a dielectric 316, and lock 320. The plug connector 300 is configured to couple to coaxial cable 308. The coaxial cable 308 includes an inner conductor 330. The inner conductor 330 electrically couples to the center contact assembly 312. A cable braid of the coaxial cable electrically couples to the outer contact assembly 314. The center contact assembly 312 is received within the dielectric 316. The dielectric 316 is received within the outer contact assembly 314. The housing 302 encloses the outer contact assembly 314, the dielectric 316, and the center contact assembly 312.

The center contact assembly 312 includes a socket 332 and a crimp barrel 334. The crimp barrel 334 crimps to the inner conductor 330 of the cable 308. The socket 332 of the center contact assembly 312 extends axially from the crimp barrel 334. The center contact assembly 312 is positioned within the dielectric 316 of the plug connector 300. The dielectric 316 includes a mating end 336 and a wire end 338. The wire end 338 is configured to receive the formed crimp barrel 334 of the center contact assembly 312. The socket 332 of center contact assembly 312 extends through and is axially centered within the mating end 336 of the dielectric. The socket 332 and the dielectric mating end 336 are configured to mate with the center contact assembly tip 132 of the cable jack connector 100.

The outer contact assembly 314 includes a cable receptor 346 and a cable retainer 348. The cable receptor 346 and the cable retainer 348 are similar to the cable receptor 146 and the cable retainer 148, respectively, and include many of the same features and method of assembly. The cable receptor 346 and the cable retainer 348 are stamped and formed pieces. The cable receptor 346 is configured to receive the coaxial cable 308. The cable retainer 348 is positioned within the cable receptor 346 to retain the coaxial cable 308 therein. The cable retainer 348 includes at least one cable retention contact (not shown) that is similar to cable retention contact 204 and pierces a jacket and engages a cable braid of the coaxial cable 308. Optionally, the at least one cable retention contact also pierces a cable dielectric of the coaxial cable 308. The cable retention contact electrically couples to a braid of the coaxial cable 308 to the outer contact assembly 314. The cable receptor 346 includes an outer contact 350. The outer contact 350 includes a mating end 352 and a wire end 354. The mating end 352 of the outer contact 350 is configured to mate with the outer contact 150 of the cable jack connector 100.

The dielectric 316 is configured to be received within the outer contact 350. The wire end 338 of the dielectric 316 is sized to be received within the wire end 354 of the outer contact 350. The mating end 336 of the dielectric 316 is sized to be received within the mating end 352 of the outer contact 350. The outer contact 350 is separated from the center contact assembly 312 by the dielectric 316. The outer contact 350, the dielectric 316, and the center contact assembly 312 form an electrical plug configured to be mated with the cable jack connector 100. The outer contact 350 is configured to engage the outer contact 150 of the cable jack connector 100. The dielectric 316 is configured to engage the dielectric 116 of the cable jack connector 100. The center contact 312 is configured to engage the center contact 112 of the cable jack connector 100.

The housing 302 encloses the outer contact assembly 314 and center contact assembly 312. The wire end 306 of the housing 302 encloses the cable receptor 346 and the cable retainer 348 of the outer contact assembly 314. The mating end 304 of the housing 302 encloses the outer contact 350, the dielectric 316, and the center contact assembly 312. The mating end 304 may also include slots 356 and 358 to mate with the keys 157 and the catch 159 of the cable jack connector 100.

The lock 320 is inserted into the wire end 306 of the housing 302 to retain the outer contact assembly 314 within the housing 302. The lock 320 includes a retention ring 360 that prevents the outer contact assembly 314 from being dislodged from the housing 302 when the coaxial cable 308 is subjected to axial forces. The lock 320 blocks axial movement, but allows the outer contact assembly 314 to rotate within the housing 302. Optionally, the outer contact assembly 314 may rotate 360 degrees within the housing 302.

The jack connector 100 may be coupled to the plug connector 300 to form a coaxial cable connector assembly. In one embodiment, the jack connector 100 and the plug connector 300 are formed according to FAKRA specifications. In one embodiment, the jack connector 100 may couple to any plug formed to FAKRA specifications. Likewise, the plug connector 300 may couple to any jack formed to FAKRA specifications.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second." and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A coaxial cable connector comprising:

a housing; and a subassembly having:

a cable receptor including a receptor portion configured to receive a cable, and an outer contact formed integrally with and extending axially from the receptor portion, the outer contact configured to electrically couple to an outer conductor of the cable;

a dielectric positioned within the outer contact of the cable receptor;

a center contact assembly positioned within the dielectric and configured to electrically couple to an inner conductor of the cable; and a cable retainer configured to couple to the receptor portion of the cable receptor, the cable retainer having at least one cable retention contact configured to retain the cable.

2. The coaxial cable connector of claim 1, wherein the subassembly is configured to rotate within the housing.

3. The coaxial cable connector of claim 1 further comprising a lock configured to retain the subassembly within the housing and prevent axial movement of the subassembly with respect to the housing.

4. The coaxial cable connector of claim 1, wherein the receptor portion of the cable receptor includes a base and a pair of side walls extending from opposite sides of the base, the base and the side walls forming a channel that receives the cable.

5. The coaxial cable connector of claim 1, wherein the cable retainer includes at least one clamping feature configured to engage the cable receptor to join the cable receptor and the cable retainer.

6. The coaxial cable connector of claim 1, wherein the center contact assembly is retained within the dielectric through an interference fit.

7. The coaxial cable connector of claim 1, wherein the cable retainer further comprises a shielding tab that positions against the outer contact of the cable receptor to provide electrical shielding.

8. The coaxial cable connector of claim 1, wherein the cable receptor further comprises at least one alignment slot and the cable retainer further comprises at least one alignment tab configured to be received in the at least one alignment slot to align to cable retainer within the cable receptor.

9. The coaxial cable connector of claim 1, wherein the cable receptor further comprises at least one window and the cable retainer comprises at least one tab configured to be received in the at least one window to lock the cable retainer within the cable receptor.

10. The coaxial cable connector of claim 1, wherein the cable receptor further comprises at least one centering tab to center the cable within the cable receptor.

11. The coaxial cable connector of claim 1, wherein the outer contact and the inner contact are configured to engage an outer contact and an inner contact of a corresponding connector.

12. A coaxial cable connector comprising:

a housing;

a subassembly configured to rotate within the housing, the subassembly comprising:

a cable receptor including a receptor portion configured to receive a cable, and an outer contact formed integrally with and extending axially from the receptor portion, the outer contact configured to electrically couple to an outer conductor of the cable;

a dielectric positioned within the outer contact of the cable receptor;

a center contact assembly positioned within the dielectric and configured to electrically couple to an inner conductor of the cable; and a cable retainer configured to couple to the receptor portion of the cable receptor, the cable retainer having at least one cable retention contact configured to retain the cable; and a lock configured to retain the subassembly within the housing and prevent axial movement of the subassembly with respect to the housing.

13. The coaxial cable connector of claim 12, wherein the receptor portion of the cable receptor includes a base and a pair of side walls extending from opposite sides of the base, the base and the side walls forming a channel that receives the cable.

14. The coaxial cable connector of claim 12, wherein the cable retainer includes at least one clamping feature configured to engage the cable receptor to join the cable receptor and the cable retainer.

15. The coaxial cable connector of claim 12, wherein the center contact assembly is retained within the dielectric through an interference fit.

16. The coaxial cable connector of claim 12, wherein the cable retainer further comprises a shielding tab that positions against the outer contact of the cable receptor to provide electrical shielding.

17. The coaxial cable connector of claim 12, wherein the cable receptor further comprises at least one alignment slot and the cable retainer further comprises at least one alignment tab configured to be received in the at least one alignment slot to align to cable retainer within the cable receptor.

18. The coaxial cable connector of claim 12, wherein the cable receptor further comprises at least one window and the cable retainer comprises at least one tab configured to be received in the at least one window to lock the cable retainer within the cable receptor.

19. The coaxial cable connector of claim 12, wherein the cable receptor further comprises at least one centering tab to center the cable within the cable receptor.

20. The coaxial cable connector of claim 12, wherein the outer contact and the inner contact are configured to engage an outer contact and an inner contact of a corresponding connector.

* * * * *